US007743942B1

(12) United States Patent
Chang

(10) Patent No.: US 7,743,942 B1
(45) Date of Patent: Jun. 29, 2010

(54) DISPENSING WHEEL ALIGNMENT DEVICES IN VENDING MACHINE

(76) Inventor: Kil Jae Chang, T.PiCO, Korea Co., Ltd., 321-37 Suksu, 2 Dong, Anyang City, Kyungdido (KR)

( * ) Notice: Subject to any disclaimer, the term of this patent is extended or adjusted under 35 U.S.C. 154(b) by 351 days.

(21) Appl. No.: 11/728,707

(22) Filed: Mar. 26, 2007

Related U.S. Application Data

(60) Provisional application No. 60/837,116, filed on Aug. 11, 2006, provisional application No. 60/878,426, filed on Jan. 3, 2007.

(51) Int. Cl.
*B65H 1/00* (2006.01)
*G07F 11/10* (2006.01)

(52) U.S. Cl. ..... 221/133; 221/122; 221/152; 221/154; 194/232

(58) Field of Classification Search ..... 194/232; 221/24, 76, 119, 121–123, 151, 152, 154, 221/155, 266, 277; 312/42, 97.1
See application file for complete search history.

(56) References Cited

U.S. PATENT DOCUMENTS 2,664,227 A 12/1953 Probasco
3,804,294 A 4/1974 Householder
4,534,492 A 8/1985 Schwarzli
5,025,908 A * 6/1991 Ullman et al. ..... 194/227
5,191,998 A 3/1993 Schwarzli
5,259,532 A 11/1993 Schwarzli
5,452,822 A 9/1995 Haymond
5,794,816 A 8/1998 Pliler et al.
5,984,171 A * 11/1999 Schwarzli ..... 232/15
6,079,540 A * 6/2000 Bolen ..... 194/255
6,135,260 A * 10/2000 Schwarzli ..... 194/255
2004/0206602 A1* 10/2004 Chang ..... 194/254
2005/0077311 A1* 4/2005 Chang ..... 221/121

* cited by examiner

*Primary Examiner*—Jeffrey A Shapiro
(74) *Attorney, Agent, or Firm*—John R. Flanagan; Ethan A. McGrath

(57) ABSTRACT

A vending machine has a dispensing wheel rotatably mounted on a head with an outer peripheral rim on the wheel having elements displaced angularly from one another in an endless row and radially relative to a central axis of the wheel so as to define a driven gear on the wheel and an alignment device permitting latching of the wheel at, and releasing it from, a desired orientation on the head in a dispensing cycle such that during removing the head from, and remounting it upon, a housing the wheel will be held in a desired relationship with the head in which only given items can pass through the wheel in response to the next deposit of a coin in an actuation mechanism and rotating of a drive gear of the mechanism and driven gear therewith through an actuation cycle corresponding to the dispensing cycle.

12 Claims, 7 Drawing Sheets

DISPENSING WHEEL ALIGNMENT DEVICES IN VENDING MACHINE

This patent application claims the benefit of U.S. provisional application Nos. 60/837,116 and 60/878,426, respectively filed Aug. 11, 2006 and Jan. 3, 2007.

BACKGROUND OF THE INVENTION

1. Field of the Invention

The present invention generally relates to vending machines and, more particularly, is concerned with dispensing wheel alignment devices in vending machines.

2. Description of the Prior Art

One general type of prior art vending machine, that has been manufactured and sold heretofore by the inventor herein, includes a merchandise storage and dispensing head, a housing supporting the head, a coin-actuated mechanism mounted on and extending into the interior of the housing to where the mechanism operably engages the head, and a coin box disposed in a lower base of the housing below the mechanism for receiving coins from the operation of the coin-actuated mechanism. An upper body of the housing rests on the lower base which closes the bottom of the housing. The upper body of the housing has an interior compartment and supports the merchandise storage and dispensing head at an upper open end of the upper body of the housing. The coin box is typically accessible through one of the end walls of the housing lower base by a key-actuated lock.

More particularly, the merchandise storage and dispensing head includes a globe or canister, a hopper and a dispensing wheel. The canister is disposed above the upper open end of the upper body for storing the items of merchandise in the globe. The hopper is attached to and disposed below the globe and supported on the upper open end of the upper body. The dispensing wheel is seated within the hopper so as to underlie the globe and revolve in the hopper to dispense a preset amount of items of the merchandise from the globe, in response to operation of the coin-actuated mechanism, into a dispensing chute typically mounted to and disposed within the upper body below the dispensing wheel and extending to a location at the exterior of the upper body where the preset amount of items can be retrieved by a user.

The coin-actuated mechanism has exposed at the exterior of the upper body a coin deposit slot and a handle accessible for operation by a user. The handle can be rotated when one or more coins of correct denomination, or properly configured tokens, are inserted into the coin deposit slot. Rotation of the handle, in turn, rotates a gear meshing with a toothed edge of the dispensing wheel within the upper body compartment such that rotation of the coin-actuated mechanism causes the dispensing wheel to revolve and dispense merchandise through the dispensing chute. Also, as the coin-actuated mechanism completes its rotation the coin or token is discharged from it into the coin box in the lower base below the upper body compartment.

In this type of vending machine, the head and housing are held together by a central assembly rod which at a lower end bypasses the coin box and is threadably affixed to the bottom wall of the lower base. The central assembly rod extends therefrom upwardly from the lower base through the interior compartment of the upper body and therefrom through the dispensing wheel and the globe to a top cap which seats on and closes an open top of the globe. At such top location of the vending machine, an upper end of the assembly rod is locked into a top key-operated lock that is threaded onto the upper end of the central assembly rod so as to provide sufficient downward force against the top cap to secure together all components of the vending machine between the lower base and the top cap.

It is essential to initially correctly assemble the merchandise storage and dispensing head upon the housing and to do so after each replenishment of merchandise in the canister of the head, in order to ensure that the initial or starting position of the dispensing mechanism in its operating cycle of rotation is properly aligned with a drive gear of the coin actuation mechanism so that the dispensing of the desired quantity or amount of merchandise from the dispensing mechanism to the discharge chute will occur in response to each coin deposited in the coin actuation mechanism. Heretofore, it has been the responsibility of persons who place the head upon the housing to manually rotate and thereby adjust the dispensing mechanism to the desired angular position in its rotation cycle at which the dispensing mechanism is properly aligned with the drive gear of the coin actuation mechanism. However, it frequently arises that many such persons fail to accurately place the dispensing mechanism at the desired starting position which then results in malfunction of the dispensing mechanism in the form of jamming of the merchandise in the dispensing mechanism or improper dispensing of more merchandise that than desired in response to each coin that is deposited in the coin actuation mechanism such that the owner of the vending machine suffers a loss in revenue as a result.

Consequently, a need exists for an innovation which provides a solution to the aforementioned problem in the prior art without introducing any new problems in place thereof.

SUMMARY OF THE INVENTION

The present invention provides a dispensing wheel alignment device designed to satisfy the aforementioned need. The dispensing wheel alignment device of the present invention facilitates and ensures accurate alignment of the dispensing wheel with the drive gear of the coin actuation mechanism thereby eliminating the potential for jamming of merchandise in the dispensing mechanism or for improper dispensing of more merchandise that desired in response to each coin deposited such that the owner of the vending machine will receive the desired amount of revenue for the quantity of merchandise that is dispensed by the vending machine.

Accordingly, the present invention is directed to a coin-operated vending machine which includes: (a) a housing; (b) a merchandise storage and dispensing head adapted for holding vendable items being removably mounted on the housing and a dispensing mechanism mounted to the head and within the housing, the dispensing mechanism having a rotatable dispensing wheel with an outer peripheral rim thereon defining a plurality of elements angularly displaced from one another in an endless row and extending radially relative to a central axis of the rotatable dispensing wheel so as to define a driven gear on the dispensing wheel; (c) a coin-operated actuation mechanism mounted to the housing and having a drive gear mounted for rotation about an axis extending in a generally orthogonal relation to the central axis of the rotatable dispensing wheel, the drive gear being disposed below the dispensing mechanism and intermeshed with at least one of the elements of the driven gear when the head is mounted on the housing such that rotation of the drive gear through a given actuation cycle will cause rotation of the dispensing wheel through a dispensing cycle via the drive gear successively intermeshing with the elements of the driven gear to thereby permit dispensing of a given number of the vendable items through the dispensing mechanism to a discharge location on the housing; and (d) a dispensing wheel alignment device having a releasable latch movably mounted to the dispensing mechanism and a detent defined on the outer rim of the rotatable dispensing wheel so as to permit releasable engagement of the releasable latch with the detent and thereby latching the dispensing wheel at, and releasing it from, a desired orientation in the dispensing cycle such that during removing the head from, and remounting the head upon, the housing the dispensing wheel will be held in a predetermined relationship with the head in which only the given number of vendable items can pass through the dispensing mechanism in response to a next deposit of a coin in the coin actuation mechanism and rotation of the drive gear through the actuation cycle corresponding to the dispensing cycle.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
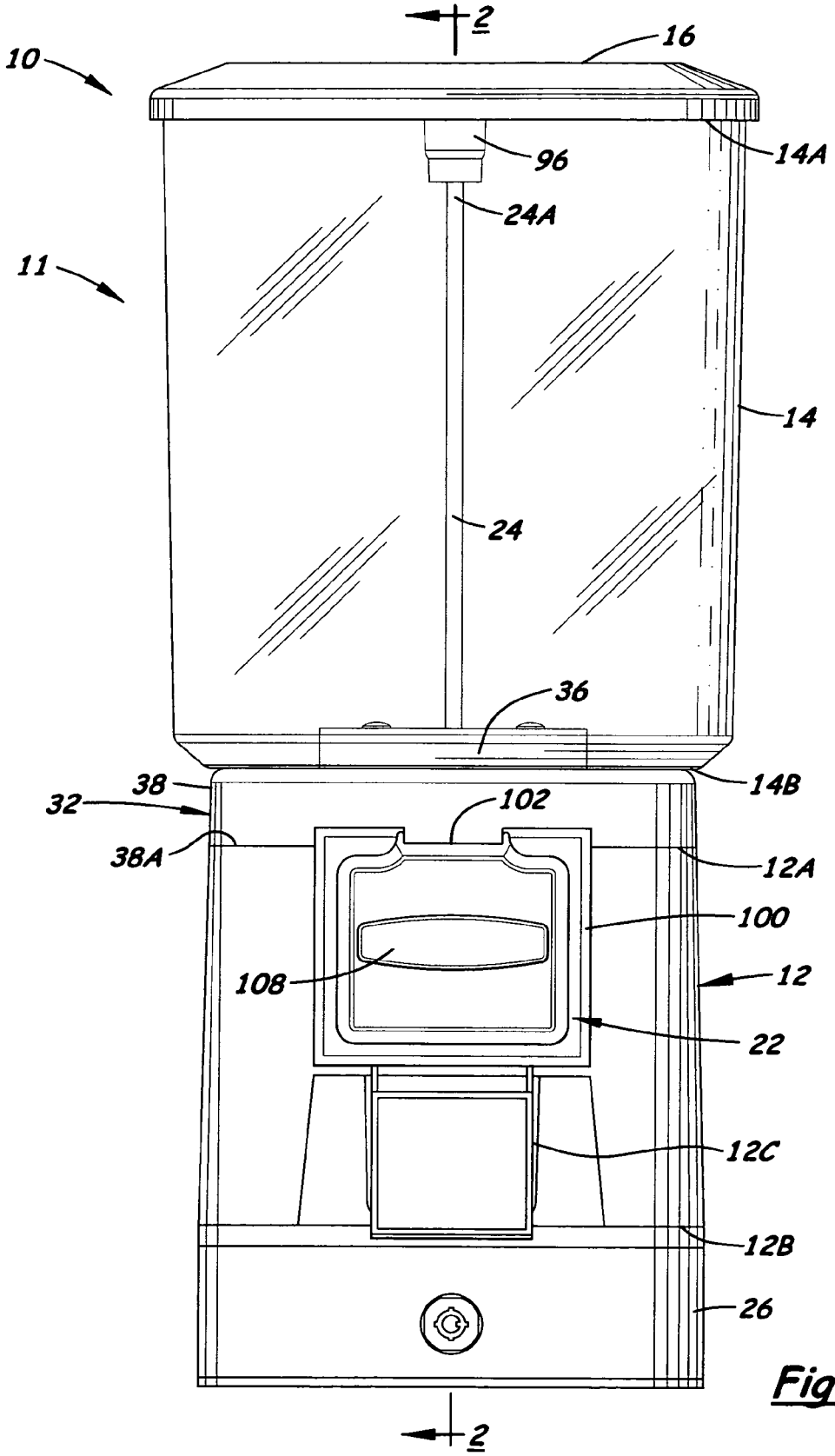
FIG. 1 is a front elevational view of a first coin-operated vending machine incorporating a first dispensing wheel alignment device of the present invention.
Figure 2:
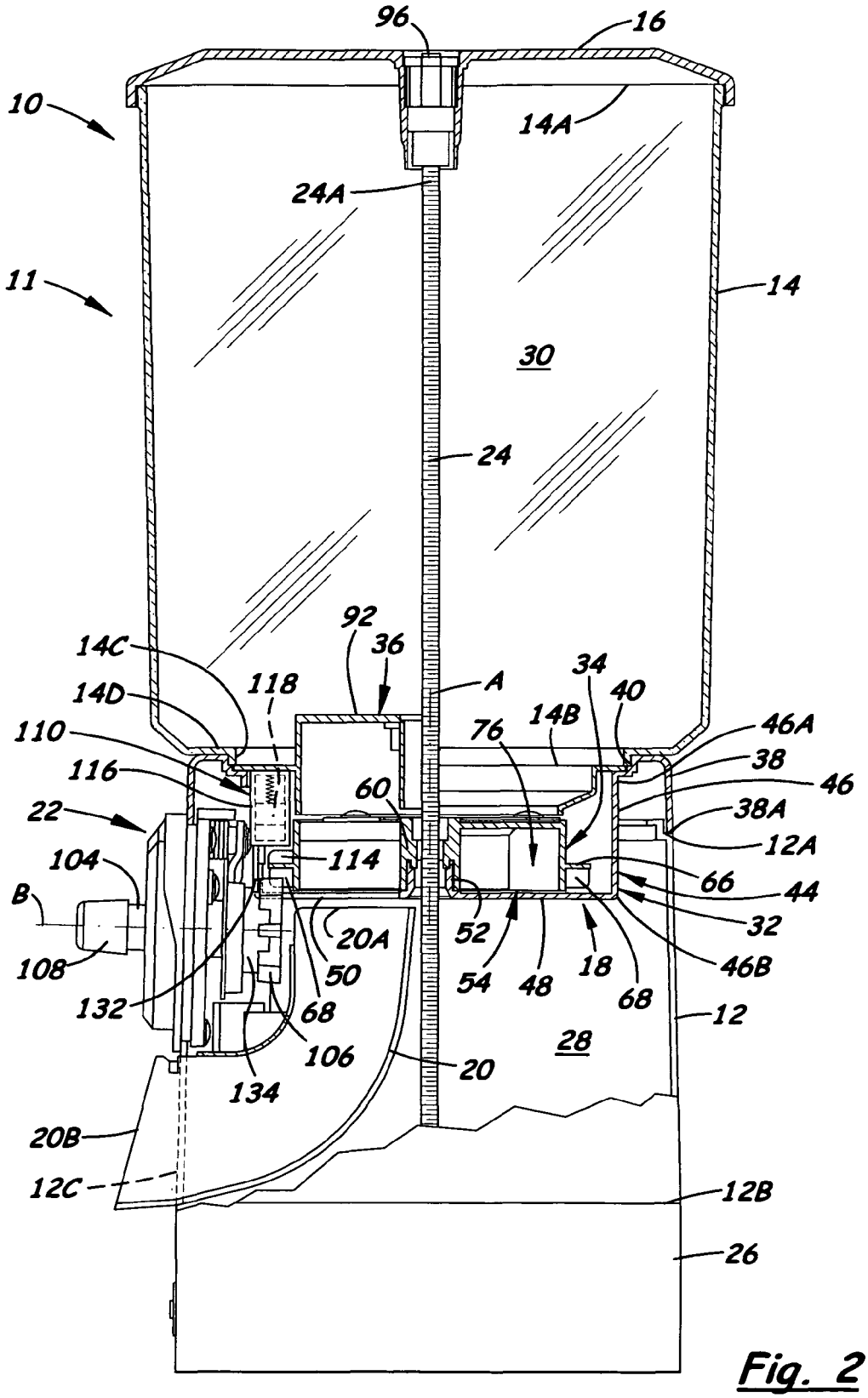
FIG. 2 is a vertical sectional view of the machine taken along line 2-2 of FIG. 1.
Figure 3:
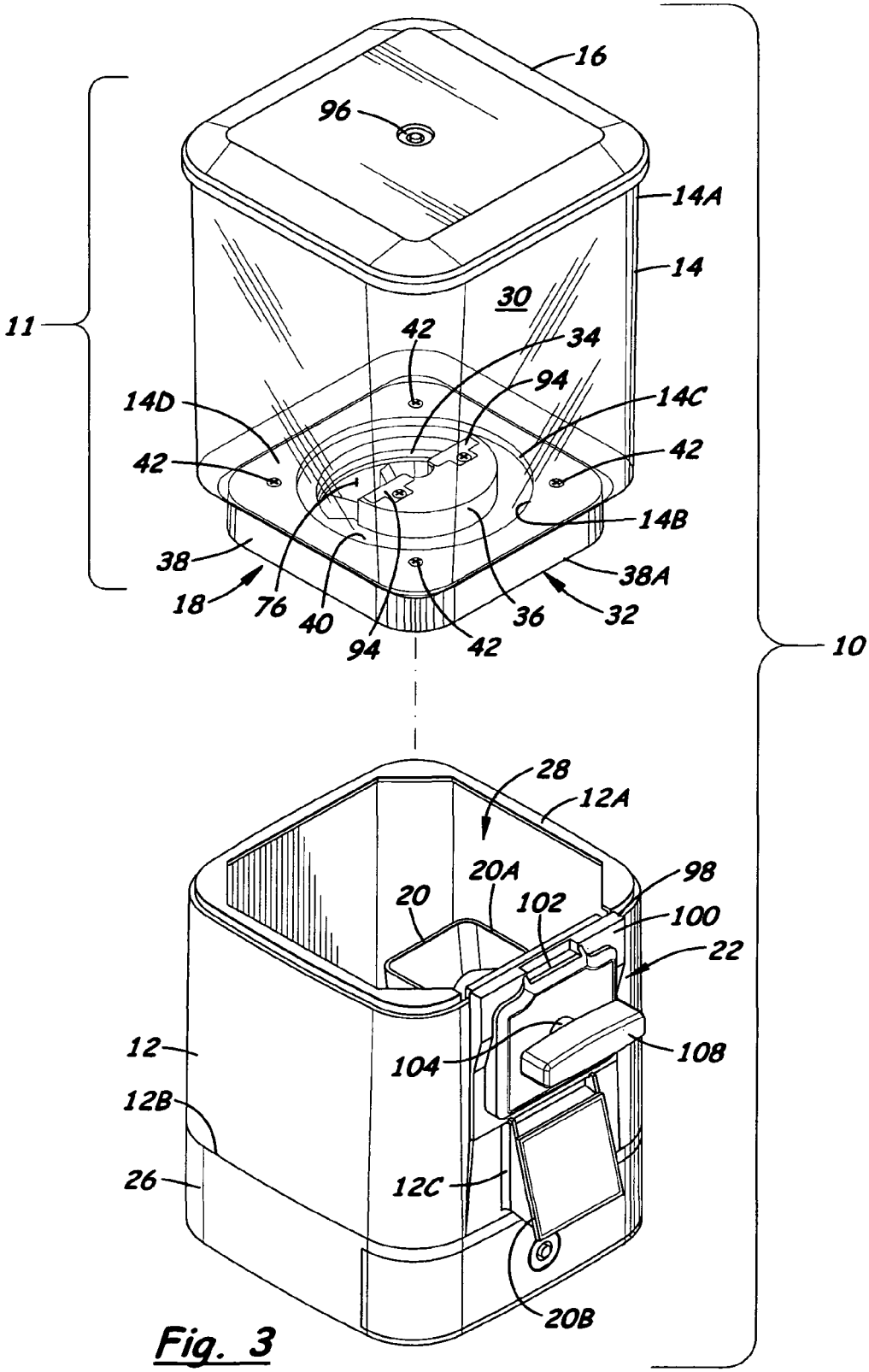
FIG. 3 is an exploded view of a housing and merchandise storage and dispensing head of the machine of FIG. 2.
Figure 4:
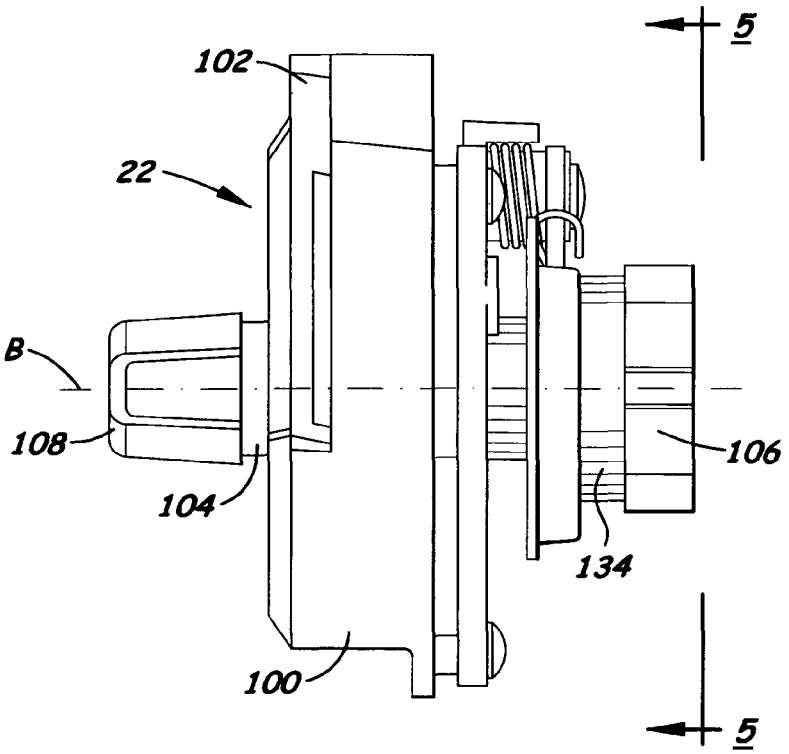
FIG. 4 is a side elevational view of a coin actuation mechanism of the machine of FIG. 1 being shown removed from the machine.
Figure 5:
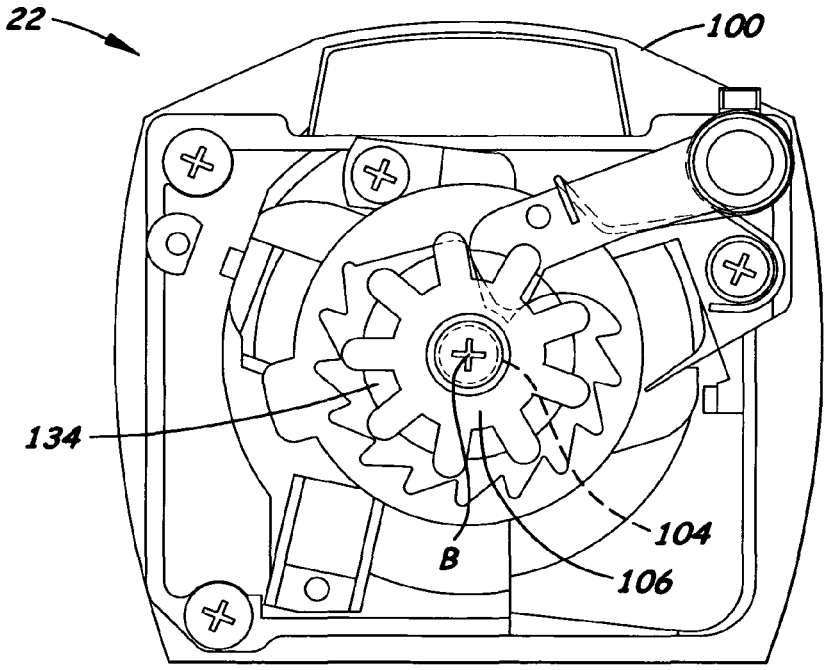
FIG. 5 is a rear elevational view of the coin actuation mechanism taken along line 5-5 of FIG. 4.

Referring to the drawings and particularly to FIGS. 1 to 3, there is illustrated a first coin-operated vending machine, generally designated 10, incorporating an exemplary embodiment of a first dispensing wheel alignment device, generally designated 110, of the present invention, being best seen in FIGS. 2 and 6-9. Basically, the first vending machine 10 includes a merchandise storage and dispensing head 11 and a housing 12 supporting the head 11. The head 11 includes a canister 14, a removable cap 16 fittable upon an open upper end 14A of the canister 14, and a dispensing mechanism 18 connected to an open lower end 14B of the canister 14. The vending machine 10 also includes a discharge chute 20 disposed within and supported by the housing 12, a coin-operated actuation mechanism 22 disposed both within and without and supported by the housing 12, and an elongated support rod 24 extendible through and connnectible to the housing 12 and removable cap 16 for lockably interconnecting them together with the remainder of the storage and dispensing head 11 clamped therebetween.

More particularly, The housing 12 of the machine 10 is preferably, but not necessarily, rectangular in its overall configuration and has an open top 12A, a bottom 12B closed by a base 26, and an interior chamber 28 extending between the open top 12A and the base 26. The canister 14 of the head 11, is preferably (but not necessarily) rectangular in its overall configuration with its open upper end 14A of rectangular configuration but with its open lower end 14B of circular configuration. The canister 15 defines a reservoir 30 extending between the open upper and lower ends 14A, 14B for holding therein individual items (not shown), such as pieces of gum or candy, in a bulk quantity thereof. The canister 14 is adapted to removably fit on the open top 12A of the housing so as to close the same. The removable cap 16 being rectangular in configuration so as to conform to that of the open upper end 14A of the canister 14 is so adapted to thereby fit over the open upper end 14A of the canister 14 to close the same. The discharge chute 20, preferably of an arcuate configuration and being rectangular in cross-section, is supported in the interior chamber 28 of the housing 12 by any suitable means and has a top opening 20A for receiving items from the bulk quantity thereof in the reservoir 30 of the canister 14 and a front discharge opening 20B communicating with a front opening 12C in the housing 12 where items received in the discharge chute 20 are accessible by a user.

Referring to FIGS. 1-3 and 6, the dispensing mechanism 18 of the machine 10 is mounted to the open lower end 14B of the canister 14 of the head 11 so as to close the same. The dispensing mechanism 18 includes a hopper 32, a dispensing wheel 34 and a partial cover 36. The hopper 32 has a top peripheral rim 38 generally rectangular in configuration so as to conform to the configuration of the open top 12A of the housing 12 such that the hopper 32 at a lower peripheral edge 38A of its top peripheral rim 38 is fittable upon the open top 12A of the housing 12, as seen in FIGS. 1 and 2. The hopper 32 also has a top central opening 40 of circular configuration so as to conform to the configuration of and receive therein a circular bottom rim 14C extending about the open circular lower end 14B of the canister 14. The canister 14 also has a generally rectangular flange portion 14D, surrounding and terminating into the circular bottom rim 14C, which seats upon, and is attachable by screws 42 to the top peripheral rim 38 of the hopper 32. The hopper 32 further has a receptacle 44 defined by a continuous side wall 46 of cylindrical configuration and a bottom wall 48 of circular configuration. The side wall 46 at its top edge 46A is attached about the central opening 40 of the top peripheral rim 38 and extends downward therefrom to a bottom edge 46B. The bottom wall 48 is attached to the bottom edge 46B and extends thereacross so as to substantially close the receptacle 44 with only a portion of the bottom wall 48 being removed to define a bottom opening 50 (see FIGS. 2 and 6) in the hopper receptacle 44 which is aligned above the top opening 18A of the discharge chute 20 such that items received from the reservoir 30 of the canister 14 can pass through the bottom opening 50 of the receptacle 44 due to the operation of the dispensing wheel 34 by the coin-operated actuation mechanism 22, as explained below. The receptacle 44 further has a central post 52 fixedly mounted on the bottom wall 48 and extending upwardly therefrom.

The dispensing wheel 34 of the dispensing mechanism 18 is mounted within the receptacle 44 of the hopper 32. The dispensing wheel 34 includes a circular member 54 and a wing structure 56. The circular member 54 has a generally circular outer wall 58, an inner hub 60 disposed within and centrally of the outer wall 58, and a plurality of vane-like sections 62 angularly displaced from one another about the inner hub 60 and extending radially between and interconnecting the outer wall 58 and inner hub 60 so as to dispose the outer wall 58 and inner hub 60 in coaxial relationship with one another relative to a central axis A of the hopper 32 defined by the central post 52 of its receptacle 44. The vane-like sections 62 together with the outer wall 58 and inner hub 60 define a plurality of passages 64 through the dispensing wheel 34. By way of example, there are three vane-like sections 62 defining three passages 64 through the dispensing wheel 34. The dispensing wheel 34 at its inner hub 60 is supported upon the central post 52 of the receptacle 44 so as to mount the dispensing wheel 34 in the hopper 32 for undergoing rotation about the central axis A of the hopper 32. The dispensing wheel 34 also has an outer rim 66 attached to and surrounding the outer wall 58 and protruding outwardly from the outer wall 58 and spaced above but closer to a lower edge 58A than to an upper edge 58B of the outer wall 58. The dispensing wheel 34 further has a plurality of ribs 68 attached on a lower surface 66A of the outer rim 66 and protruding downwardly therefrom. The ribs 68 are angularly disposed from one another and extend radially relative to the central axis A of the receptacle 44 so as to define a driven gear 69 on the underside or lower surface 66A of the outer rim 66 of the circular member 54 of the dispensing wheel 34.

The wing structure 56 of the dispensing wheel 34 includes a central ring 70, a plurality of disc segments 72 attached to and extending outwardly from the central ring 70 and being angularly displaced from one another and each having a pair of radial edges 72A, 72B, and a plurality of paddle-like structures 74 each attached along one 72A of the radial edges 72A, 72B of each of the disc segments 72. The passages 64 through the circular member 54 between the vane-like structures 62 and the outer wall 58 and inner hub 60 together with the bottom wall 48 of the hopper receptacle 44 define a plurality of cavities or pockets 76 in the dispensing mechanism 20 capable of receiving items from the reservoir 14C of the canister 14. The wing structure 56 overlies and extends into the pockets 76 of the circular member 54 and is attached to the vane-like sections 62 of the circular member and adjustably displaceable relative thereto so as to preset the volume of the pockets 76 in the dispensing mechanism 22 and thereby the volume of the passages 64 through the dispensing wheel 34 so as to accommodate a preset number of the items from the reservoir 30 of the canister 14. The wing structure 56 at its disc segments 72 seats upon the vane-like sections 62 and is adjustably fastened thereto by screws 78 extending through slots 80 in the disc segments 72 and threaded into holes 82 formed in the sections 62.

The partial cover 36 of the dispensing mechanism 18 includes an annular wall structure 84 defining a central opening 86 through the partial cover 36, and an outer peripheral flange 88 attached to and extending about the annular wall structure 84 and being attachable to the outer peripheral rim 38 of the hopper 32 at bosses 90 by suitable fasteners (not shown) to fixedly support the partial cover 36 on the hopper 32 such that the flange 88 extends radially inwardly therefrom and partially across the central opening 86 of the outer peripheral rim 38 of the hopper 32 so as to disposed the annular wall structure 84 in an overlying relation above the outer wall 58 of the circular member 54 of the dispensing wheel 34. The partial cover 36 also includes a superstructure 92 of generally semi-cylindrical shape attached upon the annular wall structure 84 and closing an angular portion of the central opening 86 of the partial cover 36 and a portion of the pockets 76 of the dispensing wheel 34 so as to permit communication between the reservoir 30 of the canister 14 and uncovered portions of at least one of the pockets 76 of the dispensing wheel 34. The semi-cylindrical superstructure 92 also supporting sweepers 94 adjacent to the top of the dispensing wheel 34 so as to ensure that only items to be dispensed fall into each of the pockets 76 of the dispensing wheel 34, as excess items are prevented from overflowing the pockets 76, as the dispensing wheel 34 rotates relative to the central axis A of the hopper 32 and under the superstructure 92 of the partial cover 36.

Referring now to FIG. 2, in order to hold the first vending machine 10 in an assembled condition but to permit its disassembly and removal of the canister 14 and the dispensing mechanism 18 of the head 11 therewith from the housing 12, the machine 10 employs the elongated support rod 24. The rod 24 is attached at a lower end (not shown) to the base 26 of the housing 12 and extends upwardly through the housing 12, the central post 52 of the receptacle 44 of the hopper 32, the dispensing wheel 34 of the dispensing mechanism 18, the reservoir 30 of the canister 14, and the removable cap 16 to an upper end 24A of the support rod 24. The upper end 24A can be lockably secured by a lock mechanism 96 for assembling and clamping the dispensing mechanism 18 and canister 14 between the base 26 of the housing 12 and the cap 16.

Referring now to FIGS. 1-5, the coin-operated actuation mechanism 22 of the vending machine 10 is mounted to the housing 12 so as to occupy a slot 98 defined in the housing 12 and opening at the open top 12A thereof and extending above the front opening 12C. The actuation mechanism 22 includes a mounting structure 100 defining a coin deposit slot 102 and a central drive shaft 104 mounted through the mounting structure 100 for rotation about an axis B extending in a generally orthogonal relation to the central axis A of the hopper 32 about which the dispensing wheel 34 rotates: The actuation mechanism 22 also includes a drive gear 106 attached to an inner end 104A of the drive shaft 104 for undergoing rotation therewith. The drive gear 106 is disposed in the interior chamber 28 of the housing 12 below and intermeshed with adjacent ones of the ribs 68 of the driven gear of the dispensing wheel 34 of the dispensing mechanism 20 such that rotation of the drive gear 106 with the drive shaft 104 of the actuation mechanism 22 will cause rotation of the dispensing wheel 34 relative to the partial cover 36 and hopper 32 of the dispensing mechanism 18. The actuation mechanism 22 further includes a knob 108 attached to an outer end 104B of the drive shaft 104 such that upon deposit by a user of a given coin in the coin deposit slot 102 in the mounting structure 100 of the actuation mechanism 22 and by the user turning the knob 108 through a given portion of at least one revolution, the drive shaft 104 and drive gear 106 are rotated and cause the dispensing wheel 34 to rotate through a given dispensing cycle permitting the items in a given one of the pockets 76 to pass over the bottom opening 50 in the bottom wall 48 of the hopper receptacle 44 and drop from the one pocket 76 into the top opening 18A of the discharge chute 18 and through the discharge chute 18 to the discharge opening 18B where the items can be accessed by the user.

All components of the first vending machine 10 (except for the first dispensing wheel alignment device 110) which have been described up to this point are well-known in the prior art.

Referring now to FIGS. 2 and 6-9, there is illustrated the exemplary embodiment of the first dispensing wheel alignment device 110 of the present invention, incorporated in the first vending machine 10. The first alignment device 110 cooperates with the dispensing wheel 34 of the machine 10 so as to effect either latching of the dispensing wheel 34 at, or releasing it from, a given one of a plurality of desired predetermined orientations relative to the hopper 32 and the partial cover 36 of the dispensing mechanism 18 which ensures proper dispensing of items from the machine 10 in response to each coin deposited in the actuation mechanism 22. The first alignment device 110 basically includes a first releasable latch 112 and at least one detent in the form of a protuberance 114 and preferably a plurality of detents or protuberances 114 fixed on the dispensing wheel 34. The protuberance 114 correspond in number to the pockets 76 of the dispensing wheel 34, and the first releasable latch 112 and a given one of the protuberances 114 cooperate to effect latching of the dispensing wheel 34 at, and releasing it from, the given one of the plurality of desired predetermined orientations relative to the hopper 32 and the partial cover 36 of the dispensing mechanism 18. The dispensing wheel 34 becomes latched at the given one desired orientation in response to removing the canister 14 and the dispensing mechanism 18 therewith from the housing 12 such that the dispensing wheel 34 cannot rotate relative to the partial cover 36 during the time that the canister 14 is removed from the housing 12 and, furthermore, upon remounting of the canister 14 back on the housing 12, only the given one of the pockets 76 of the dispensing wheel 34 will be retained in a predetermined flow communication with the central opening 86 through the partial cover 36 in which only the given one pocket 76 is able to receive items from the reservoir 30 of the canister 14 and pass the items through the dispensing mechanism 18 to the discharge chute 20 in response to the next deposit of a coin in the coin deposit slot 102 and the turning of the knob 108 and rotation of the drive gear 106 through a given actuation cycle corresponding to the given dispensing cycle of the dispensing mechanism 18. The dispensing wheel 34 becomes released by the releasable latch 112 in response to remounting of the canister 14 back upon the housing 12 which brings about meshing of the driven gear 69 of the dispensing wheel 34 with the drive gear 106 of the actuation mechanism 22 which, in turn, holds the dispensing wheel 34 at the given one of the orientations ensuring proper alignment of the dispensing wheel 34 with the partial cover 36 and thus proper operation of the dispensing mechanism 18 in its next dispensing cycle.

Figure 6:
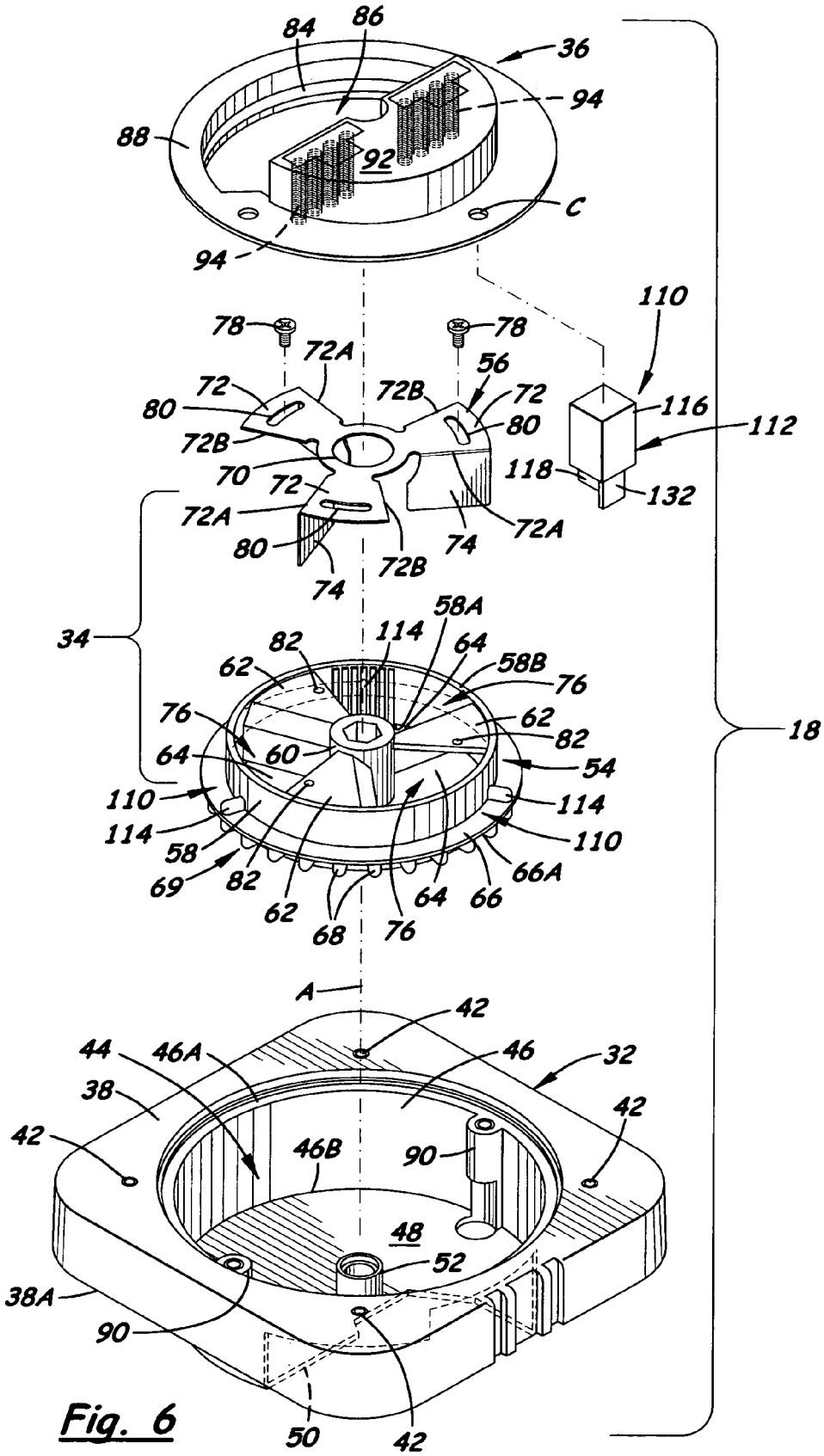
FIG. 6 is an exploded perspective view of the dispensing mechanism of the machine of FIG. 3.
Figure 7:
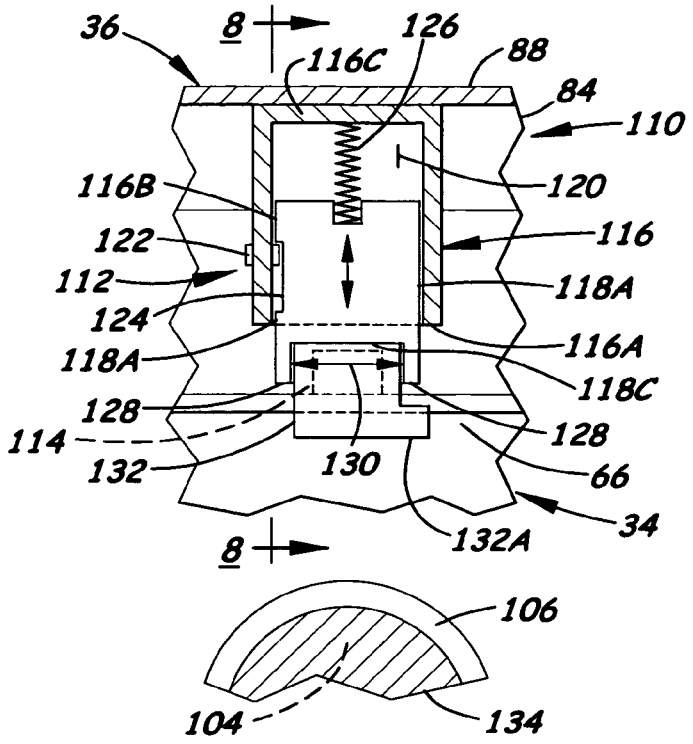
FIG. 7 is an enlarged front elevational view of a first dispensing wheel alignment device of FIG. 2 as seen along line 7-7 of FIG. 8 with a releasable latch of the device being disposed in a downward extended latching position relative to a tooth on an outer rim of the dispensing wheel.
Figure 8:
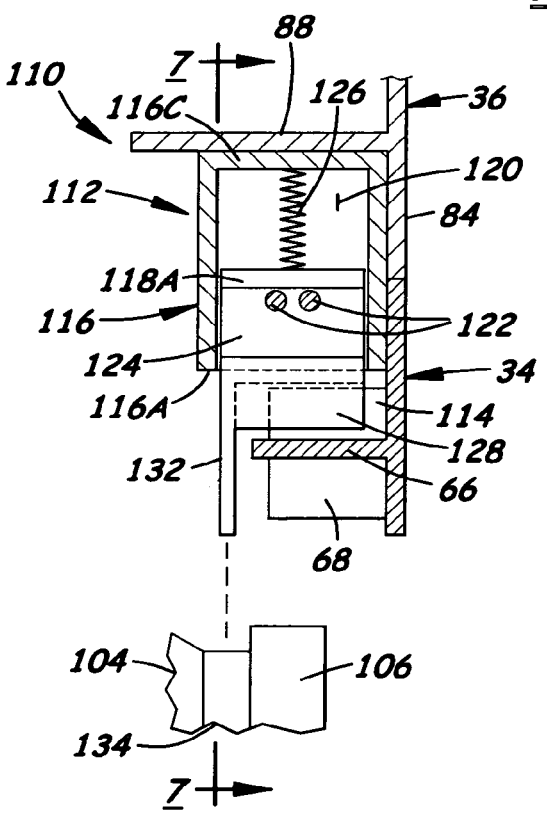
FIG. 8 is a side elevational view of the first dispensing wheel alignment device as seen along line 8-8 of FIG. 7.
Figure 9:
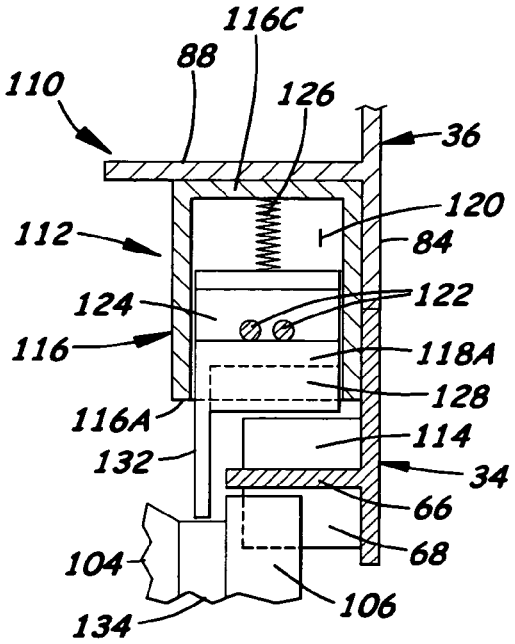
FIG. 9 is another side elevational view of the first dispensing wheel alignment device similar to that of FIG. 8 but now with the latch being disposed in an upward retracted releasing position relative to the tooth on the outer rim of the dispensing wheel.

More particularly, the first releasable latch 112 of the first alignment device 110 is mounted on the underside of the outer peripheral flange 88 of the partial cover 34 at a location, as identified by C (as shown in FIG. 6), aligned over the drive gear 106 and outer rim 66 when the canister 14 with the hopper 32 is fitted or mounted on the housing 12, as seen in FIG. 8. The first releasable latch 112 includes a case 116 of rectangular configuration and a plunger 118 slidably and reciprocally mounted in the case 116, as seen in FIGS. 7-9. The case 116 is vertically disposed and fixedly attached to the underside of the outer flange 88 and at the outside of the annular wall structure 84 of the partial cover 36 extending above the outer flange 88. As seen in FIG. 7, the case 116 defines an interior cavity 120 open at a bottom end 116A of the case 116 and at least one detent 122 attached to one side 116B of the case 116. The plunger 118 is mounted within the interior cavity 120 of the case 116 and has a recess 124 formed in one of the opposite sides 118A of the plunger 118 such that the detent 122 projecting into the interior cavity 120 from the one side 116A of the case 116 protruded into the recess 124 of the case 116 so as to retain the plunger 118 in the case 116 while permitting it to undergo reciprocal movement vertically relative to the case 116 against the downward bias of a coil spring 126 disposed in the interior cavity 120 between the top 116C of the case 116 and a top end 118B of the plunger 118, between a downward extended latching position as seen in FIG. 8 and an upward retracted releasing position as seen in FIG. 9. The plunger 118 also has a pair of spaced apart tabs 128 fixed to opposite edges of a bottom end 118C of the plunger 118 so as to define an exterior cavity 130 therebetween which opens downwardly. The plunger 118 further has a contact finger 132 attached to and extending downwardly from another edge of the bottom end 118C of the plunger 118. The contact finger 132 extends downwardly from the open bottom end 116A of the case 116 such that an outer end 132A of the finger 132 will engage a collar 134, as seen in FIG. 9, fixedly mounted about the drive shaft 104 of the actuation mechanism 24 and adjacent to the drive gear 106, and cause the plunger 118 to compress the spring 126 retract into the interior cavity 120 of the case 116.

As stated above, the teeth 114 correspond in number to the pockets 76 of the dispensing wheel 34 and are affixed on the upper surface 66B of the outer rim 66 of the dispensing wheel 34 and are angularly displaced from one another such that when any one of these protuberances 114 is aligned with and captured or mated within the exterior cavity 130 defined between the two tabs 128 on lower end 118C of the plunger 118, the dispensing wheel 34 will be disposed at a corresponding one of its plurality of correct starting orientations relative to the coin actuation mechanism drive gear 106. The rotatable dispensing wheel 34 preferably has three possible correct orientations relative to the drive gear 106 of the actuation mechanism 24 which are angularly displaced from one another by approximately 120 degrees so that each corresponds to one of preferably three desired initial or starting positions of the preferably three pockets 76 defined in the dispensing wheel 34, such that upon the canister 14, filled with the bulk quantity of items, being installed on the housing 12, the plunger 119 and its tabs 130 are in the downwardly extended or displaced latching position shown in FIG. 8 mated with the one of the protuberances 114, preventing the dispensing wheel 34 from rotating away from the corresponding one of the three correct orientations such that the ribs 68 of the driven gear 69 will assume a correct intermeshing with the drive gear 106 when the canister 14 with the hopper 32 is then seated on the housing 12. Concurrently with seating the canister 14 with the hopper 32 on the housing 12, an outer portion 134A of the collar 134 of the actuation mechanism 24 adjacent to the drive gear 106 is contacted by the finger 132 and the finger 132 is lifted upward which, in turn, lifts the plunger 118 and pair of tabs 128 upwardly with it to above the given one protuberance 114 to a releasing position seen in FIGS. 2 and 9 in which the one protuberance is no longer captured or mated by the tabs 130 on the plunger 118, as shown in FIG. 8, thus permitting the releasing or unlatching of the dispensing wheel 34 so that it can be rotated through its dispensing cycle upon rotation of the coin-operated actuation mechanism 24 in response to the next depositing of a coin in the coil slot 102. Thus, this operation of the first releasable latch 112 is automatic in response merely to the seating of the canister 14 upon the housing 12 and its removal therefrom.

However, it should be pointed out here that only a single protuberance 114 need be provided to effect latching of the dispensing wheel 34 at, and releasing it from, a given one of the starting position by manually operating the first releasable latch 112 to assume its releasing position and then rotating the dispensing wheel 34 relative thereto so as to align the single protuberance 114 with the first releasable latch 112, after which the first releasable latch 112 is then allowed to assume its latching position over the single protuberance 114.

Figure 10:
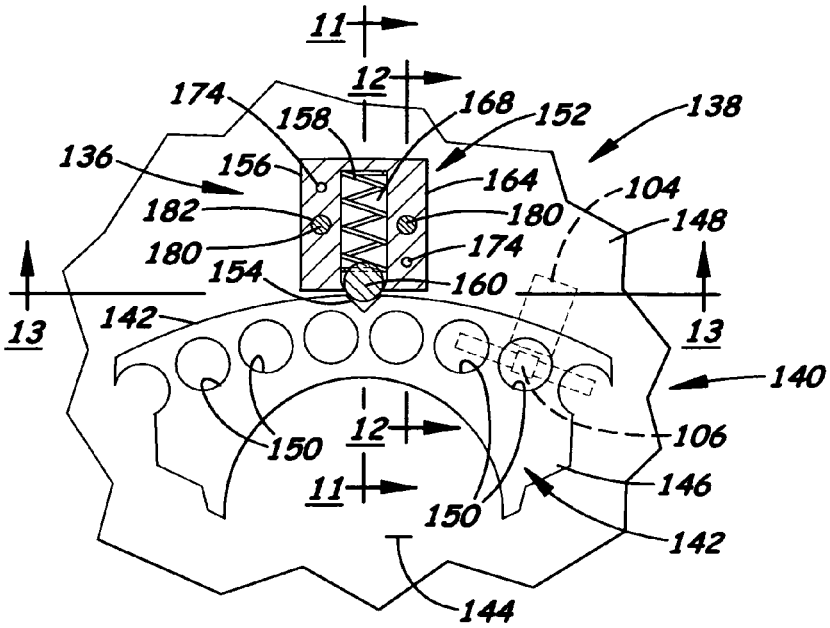
FIG. 10 is a fragmentary bottom view of a dispensing mechanism of a second coin-operated vending machine incorporating a second dispensing wheel alignment device of the present invention as seen along line 10-10 of FIG. 11.
Figure 11:
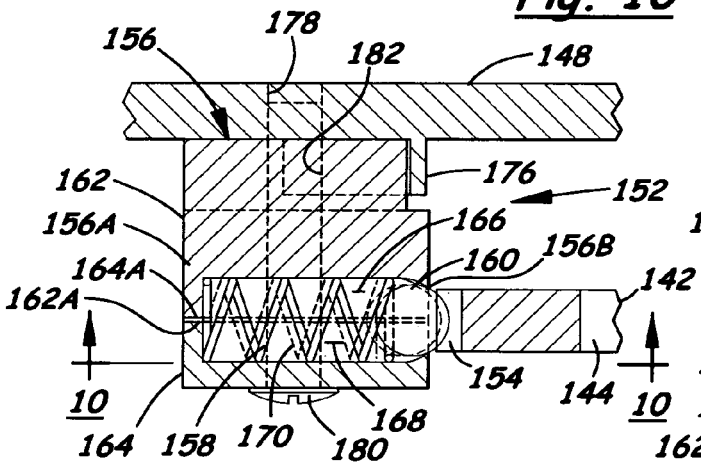
FIG. 11 is a vertical longitudinal sectional view of the second dispensing wheel alignment device as seen along line 11-11 of FIG. 10.
Figure 12:
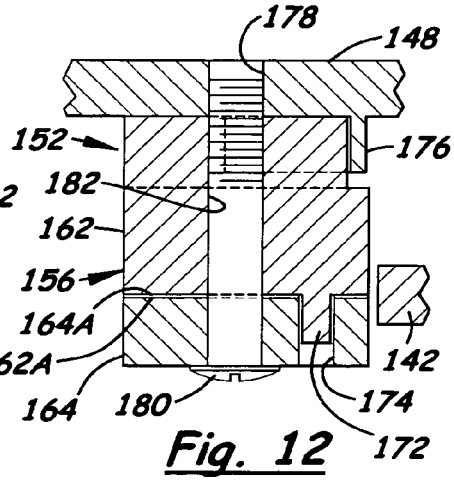
FIG. 12 is another vertical longitudinal sectional view of the second dispensing wheel alignment device as seen along line 12-12 of FIG. 10.
Figure 13:
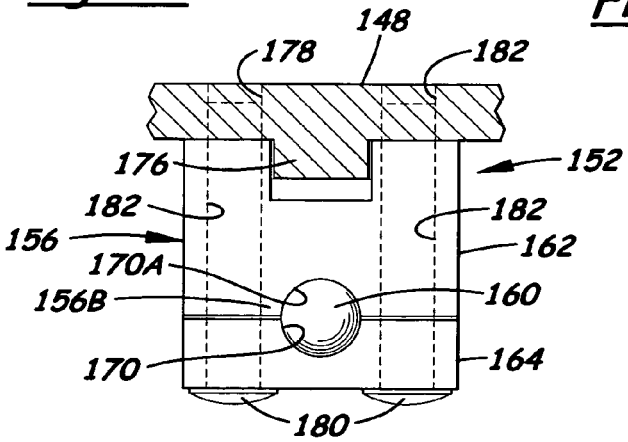
FIG. 13 is a vertical front elevational view of the second dispensing wheel alignment device as seen along line 13-13 of FIG. 10.

Referring now to FIGS. 10-13, there is illustrated an exemplary embodiment of a second alignment device of the present invention, generally designated 136, incorporated into a second vending machine 138, only a fragment of the second machine being shown in FIG. 10. The second vending machine 138 basically employs a housing, removable top cap, support rod, discharge chute and coin-operated actuation mechanism substantially similar to those same components of the first vending machine 10. However, the second vending machine 138 employs a head with a dispensing mechanism 140 (only a portion of which is shown in FIG. 10) which is somewhat different from the head 11 and dispensing mechanism 18 of the first vending machine 10. The dispensing mechanism 140 of the second vending machine 138 includes a dispensing wheel 142 in the form of a flat plate of a generally circular configuration which is only fragmentarily shown in FIG. 10. The dispensing wheel 142 has a plurality of large circular openings 144 (only one of which being partially shown in a bottom view in FIG. 10) formed therein and angularly spaced from one another about the dispensing wheel 142 by a plurality of solid spacer portions 146 disposed between the openings 144. The dispensing wheel 142 is spaced below a lower platform 148 of the head which fits or mounts upon and closes the top opening of the housing of the second vending machine 138. The lower platform 148 has a single dispensing passage (not shown) defined therein by an opening formed therein and a section of tube, relative short in height, affixed to the bottom of the lower platform 148 in alignment with and extending downward from the opening and between the lower platform 148 and the dispensing wheel 142. The head also includes a generally circular carousel (not shown) disposed above the lower platform 148 having a plurality of storage columns angularly displaced from one another and each open at the top and bottom for receiving and holding therein a stack of items, such as flat circular mints or the like, and for discharging such items one at time from the bottom of the stack. The dispensing wheel 142 and the carousel of the head are fixedly interconnected to one another at central locations thereon by a central connector which extends through a central boss in the lower platform 148 such that the carousel of the head and the dispensing wheel 142 are rotatable in unison with one another relative to the stationary lower platform 148 of the head.

While the plurality of columns of the carousel are the same in number, for example five, as the plurality of openings 144 of the dispensing wheel 142, they are not vertically aligned above the respective openings 144. Instead, the columns are vertically aligned above the respective solid spacer portions 146 of the dispensing wheel 142 such that when one of the columns is disposed above the dispensing passage through the lower platform 148 the one column is aligned with the one of the solid spacer portions 146 disposed between the openings 144 in the dispensing wheel 142. Thus, the one item to be dispensed is retained in the dispensing passage until the carousel and the dispensing wheel 142 are rotated relative to the lower platform 148 so as to complete one dispensing cycle upon rotation of the coin-operated actuation mechanism in response to the depositing of a coin in its coin slot. The dispensing wheel 142 further has a row of circumferentially spaced apart small holes 150 formed therethrough about the periphery thereof such that the drive gear 106 of the coin-operated actuation mechanism 22 drivingly intermeshes with adjacent ones of the holes 150 such that rotation of the drive gear 106 will cause rotation of the dispensing wheel 142 and the carousel therewith relative to the lower platform 148 such that upon deposit by a user of a given coin in the coin actuation mechanism 22 and by the user turning the knob of the actuation mechanism 22, the drive gear 106 is rotated and causes the dispensing wheel 142 to rotate from a desired start position through a given dispensing cycle, for example, equal to one-fifth of a full circle or seventy-two degrees permitting an item to drop from the dispensing passage through one of the openings 144 in the dispensing wheel 142 and into a discharge chute 20 of the second vending machine 138. The alignment device 136 thereby ensures that operation begins with the dispensing wheel 144 at the proper rotational orientation relative to the dispensing passage such that the potential malfunctioning of the vending machine is avoided.

The second alignment device 136 basically includes a second releasable latch 152 fixedly mounted to an underside of the stationary lower platform 148 of the head of the second vending machine 138. The second alignment device 136 also includes a detent 154 formed into the rotatable dispensing wheel 142 of the second vending machine 138. The detent 154 preferably, although not necessarily, takes the form of a V-shaped notch formed into an outer rim 142A of the dispensing wheel 142. The second releasable latch 152 is mounted at a respective location on the lower platform 148 adjacent to the dispensing wheel 142 and functions to releasably latch with the dispensing wheel 142 via the detent 154 such that a selected one of the plurality of solid spaces 146 between the openings 144 defined in the dispensing wheel 142 is disposed below the dispensing passage of the lower plate 148 at the start of a dispensing cycle. A vending machine owner can rotate the carousel and dispensing wheel 142 manually to engage the second releasable latch 152 with the detent 154 before placing the dispensing mechanism 140 upon the open top of the second vending machine housing so as to ensure proper dispensing of the items one at a time from the second vending machine in response to each coin deposited in the coin actuation mechanism to initiate each dispensing cycle of the items.

More particularly, the second releasable latch 152 includes a case 156, a coil spring 158 and a spherical ball 160. The case 156 has upper and lower parts 162, 164 having respective complementary semi-cylindrical recesses 166, 168 formed in lower and upper faces 162A, 164A thereof which cooperate to provide a cylindrical compartment 170 in the case 156 closed at a rear end 156A and open at a front end 156B of the case 156. The compartment 170 has a diameter slightly larger than the spherical ball 160 and the coil spring 158 so as to respectively rollably and slidably contain the ball 160 and spring 158 therein. An inwardly pointing cylindrical rim 170A is defined on the upper and lower parts 162, 164 about the cylindrical compartment 170 at the front end 156B of the case 156 so as to define the open front end 156B for the compartment 170 of a reduced diameter being less than that of the ball 160 preventing the ball 160 from exiting the compartment 170. The upper and lower parts 162, 164 having respective pins 172 and apertures 174 thereon to assist in accurate alignment and releasable assembly of the two parts together.

A raised abutment 176 is formed on the underside of the lower platform 148 and holes 178 are tapped into the lower platform 148 adjacent to opposite sides of the abutment 176 to facilitate placement and mounting of the case 156 on the underside of the lower platform 148. Such mounting is accomplished by inserting a pair of screws 180 through passages 182 in the case 156 adjacent to opposite sides of the compartment 170 and tightening the screws 180 in the tapped holes 178. In such position of the case 156, the front open end 165B of the compartment 170 is spaced a short distance from the detent 154 formed in the dispensing wheel 142 such that the compression or bias force of the coil spring 158 will retain the ball 160 at an extended latching position, as shown in solid line form in FIGS. 10 and 11, mated with the detent 154 so as to hold the dispensing wheel 142 at its desired initial starting position. The coil spring 158 is sufficiently soft and yieldable or compressible that a user can easily overcome the bias force of the spring 158, allowing movement of the ball 160 to a retracted releasing position, as shown in dashed line form in FIG. 11, in response to turning the knob of the coin actuation mechanism and thereby causing the rotation of the drive gear 106 to, in turn, cause rotation of the dispensing wheel 142.

It should be understood that the second alignment device 136 can be applied to the first vending machine 10 as an alternative to the use of the first alignment device 110. The second releasable latch 152 of the second alignment device 136 will cooperate with, via resiliently and yieldably engaging in, the detent 154 when defined in an outer edge 66A of the continuous peripheral outer rim 66 of the dispensing wheel 34, at a suitable location angularly displaced from the drive gear 106 (such as seen in FIG. 10), so as to effect either latching of the dispensing wheel 34 at, or releasing it from, the given desired predetermined orientation. In such manner, the second alignment device 136 would ensure proper positioning of the dispensing wheel at a start position and thereby dispensing of items from the first vending machine 10 in response to each coin deposited in the actuation mechanism 24.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A coin-operated vending machine, comprising:

(a) a housing;

(b) a merchandise storage and dispensing head adapted for holding vendable items being removably supported on said housing;

(c) a dispensing mechanism attached to said head and removably supported on said housing such that said dispensing mechanism is removed with said head, said dispensing mechanism having a rotatable dispensing wheel with an outer peripheral rim thereon having a plurality of elements angularly displaced from one another in an endless row and extending radially relative to a central axis of the rotatable dispensing wheel so as to define a driven gear on the dispensing wheel;

(d) a coin-operated actuation mechanism mounted to said housing and having a drive gear mounted for rotation about an axis extending in a generally orthogonal relation to said central axis of said rotatable dispensing wheel, said drive gear being disposed below said dispensing mechanism and intermeshed with at least one of said elements of said driven gear when said head is mounted on said housing such that rotation of said drive gear through a given actuation cycle will cause rotation of said dispensing wheel through a dispensing cycle via said drive gear successively intermeshing with said elements of said driven gear to thereby permit dispensing of a given number of the vendable items through said dispensing mechanism to a discharge location on said housing; and (e) a dispensing wheel alignment device having a releasable latch movably mounted to said dispensing mechanism and a detent defined on said outer rim of said rotatable dispensing wheel so as to permit releasable engagement of said latch with said detent and thereby latching said dispensing wheel at, and releasing it from, a desired orientation in the dispensing cycle such that during removing said head and said dispensing mechanism from, and remounting said head and said dispensing mechanism upon, said housing said dispensing wheel will be held in a predetermined relationship with said head by said dispensing wheel alignment device in which only the given number of vendable items can pass through said dispensing mechanism in response to a next deposit of a coin in said coin actuation mechanism and rotation of said drive gear through the actuation cycle corresponding to the dispensing cycle.

2. The vending machine of claim 1 wherein said releasable latch is mounted on a portion of said dispensing mechanism stationary relative to said rotatable dispensing wheel and disposed at a location overlying said outer peripheral rim of said dispensing wheel.

3. The vending machine of claim 2 wherein said detent is a protuberance attached on an upper side of said outer peripheral rim of said dispensing wheel and aligned with said releasable latch.

4. The vending machine of claim 3 wherein said releasable latch includes:

a case fixedly attached to said portion of said dispensing mechanism and defining an interior cavity open at a bottom of said case and a recess in each of a pair of opposite sides of the case;

a spring disposed in said interior cavity of said case; and a plunger reciprocally mounted within said interior cavity of said case with portions of opposite sides of said plunger protruding into said recesses in said opposite sides of said case so as to retain said plunger in said case while permitting it to undergo reciprocal vertical movement between an extended latching position and a retracted releasing position relative to said protuberance and said case against the bias of said spring disposed in said interior cavity between a top of said case and a top of said plunger.

5. The vending machine of claim 4 wherein said plunger includes:

a pair of tabs fixed to opposite edges of a bottom end face of said plunger so as to define an exterior cavity therebetween which opens downwardly; and a contact finger attached to and extending downwardly from another edge of said bottom end face of said plunger, said contact finger extending downwardly from said open end of said case such that an end of said finger will engage a collar fixedly mounted on said actuation mechanism adjacent to said drive gear when said head is remounted on said housing such that said plunger will undergo vertical movement from said extended latching position to said retracted releasing position relative to said tooth thereby releasing said dispensing wheel for rotation during the next dispensing cycle.

6. The vending machine of claim 3 wherein said plurality of elements on said outer peripheral rim are a plurality of ribs attached on a lower surface of said outer rim and protruding downwardly therefrom.

7. The vending machine of claim 1 wherein said releasable latch is mounted on said dispensing mechanism stationary relative to said rotatable dispensing wheel and disposed at a location aligned with an outer edge of said outer peripheral rim of said dispensing wheel.

8. The vending machine of claim 7 wherein said detent is a notch formed into said outer peripheral rim of said dispensing wheel and aligned with said releasable latch.

9. The vending machine of claim 8 wherein said notch is V-shaped.

10. The vending machine of claim 9 wherein said releasable latch includes:

a ball of circular configuration;

a spring; and a case fixedly attached to said housing and having a compartment of cylindrical configuration respectively rollably containing said ball within said compartment and slidably containing said spring within said compartment between said ball and a closed rear end of said case, said case having an open front end facing toward said outer peripheral rim of said dispensing wheel such that said notch in said outer rim of said dispensing wheel is alignable with said ball by rotation of said dispensing wheel, said ball being movable relative to said base between said extended latching position toward and said retracted releasing position away from said notch in said outer rim for correspondingly latching and releasing said dispensing wheel.

11. The vending machine of claim 10 wherein said case has an inwardly pointing cylindrical rim defined about said open front end of said cylindrical compartment a diameter less than a diameter of said ball thereby preventing said ball from exiting said compartment.

12. The vending machine of claim 7 wherein said plurality of elements on said outer peripheral rim are a plurality of holes defined through said outer rim between upper and lower surfaces thereon, said holes being adapted to successively intermesh with said drive gear during a dispensing cycle.

* * * * *